US006575465B2

(12) United States Patent
Lo

(10) Patent No.: US 6,575,465 B2
(45) **Date of Patent: *Jun. 10, 2003**

(54) CARD GAME

(76) Inventor: Henry T. Lo, 5010 Indian River Dr., #32, Las Vegas, NV (US) 89103

( * ) Notice: Subject to any disclaimer, the term of this patent is extended or adjusted under 35 U.S.C. 154(b) by 0 days.

This patent is subject to a terminal disclaimer.

(21) Appl. No.: 09/823,569

(22) Filed: Mar. 29, 2001

(65) Prior Publication Data

US 2001/0054796 A1 Dec. 27, 2001

Related U.S. Application Data

(63) Continuation of application No. 09/315,295, filed on May 20, 1999.
(60) Provisional application No. 60/193,309, filed on Mar. 30, 2000.

(51) Int. Cl.[7] ..... A63F 1/100
(52) U.S. Cl. ..... 273/292; 273/274; 273/309; 463/10; 463/12; 463/13
(58) Field of Search ..... 273/292, 274, 273/306; 463/26, 13, 25, 9–12, 27

(56) References Cited

U.S. PATENT DOCUMENTS 5,863,042 A * 1/1999 Lo ..... 273/292
5,984,310 A * 11/1999 English ..... 273/292
6,019,374 A * 2/2000 Breeding ..... 273/292
6,102,402 A * 8/2000 Scott et al. ..... 273/292
6,402,147 B1 * 6/2002 Lo ..... 273/292

* cited by examiner

*Primary Examiner*—Benjamin H. Layno
*Assistant Examiner*—D Collins
(74) *Attorney, Agent, or Firm*—Gerry J. Elman; Elman Technology Law, P.C.

(57) ABSTRACT

The invention is a seven-card-stud poker game, played with at least one but preferably one standard poker deck of 52 cards plus at least one but preferably one Joker. Two or more but preferably seven players may participate in the game. One of the players is the Banker whom other players play against. A Player who is not a Banker may play Poker Bet playing against the Banker's hand and/or one to seven side bets betting on the contents of the Player's own hand. After at least one wager is placed, each Player and the Banker are each dealt seven cards. The Players and the Banker each then selects and keeps his best 5-card poker hand and discards two other cards from his own seven cards. To win a Poker Bet wager, a Player's best 5-card poker hand must rank higher than the Banker's best 5-card poker hand. To win a side-bet wager, a Player's best 5-card poker hand must be one of the predetermined winning hands of the type of the side bet he bets on. The Poker Bet wager and seven side-bet wagers are eight independent wagers and are settled separately.

21 Claims, 3 Drawing Sheets

CARD GAME

CROSS REFERENCE TO RELATED APPLICATION

This application is a continuation of my U.S. patent application No. 09/315,295, filed May 20, 1999, and claims priority under 35 U.S.C. 119(e) from the Part 4 "7 Card Thrill" of the following U.S. provisional patent applications: Serial Number 60/193,309 filed Mar. 30, 2000, which is incorporated by the reference.

A Portion of the disclosure of this patent document contains material that is subject to copyright protection. I, Henry Lo, the copyright owner, have no objection to the facsimile reproduction by anyone of the patent disclosure, as it appears in the PTO patent file or records, but otherwise reserves all copyright rights whatsoever.

DESCRIPTION OF THE INVENTION

The invention is offered under trademark "Joker Wild 7 Card Thrill." The invention is a seven-card-stub poker game, played with at least one but preferably one standard poker deck of 52 cards, plus at least one but preferably one "Joker." The Joker can be used as any card. Two or more but preferably seven players may participate in the game. One of the players is the Banker whom other players play against. A Player who is not a Banker may play Poker Bet playing against the Banker's hand and/or one to seven side bets betting on the contents of the Player's own hand. After at least one wager is placed, each Player and the Banker are each dealt seven cards. From each Player's seven cards, each Player selects and keeps his or her best 5-card poker hand and discards two other cards, which are treated as two discards; i.e., from the Player's seven dealt cards AAK9754, AAK97 is the Player's best 5-card poker hand and 54 are the two discards; from the Player's seven dealt cards QQJJ655, QQJJ6 is the Player's best 5-card poker hand and 55 are the two discards. From the Banker's seven cards, the Banker selects and keeps the Banker's best 5-card poker hand and discards two other cards.

POKER BET is a bet that allows a Player to place a wager playing against the Banker's hand. The object of Poker bet is to have a best 5-card poker hand that outranks the Banker's best 5-card poker hand. In the Poker Bet game, the Player's best 5-card poker hand is compared to the Banker's best 5-card poker hand according to traditional poker rankings, wherein hands are ranked in descending order as follows: 5 of a Kind, Royal Flush, Straight Flush, 4 of a Kind, Full House, Flush, Straight, 3 of a Kind, Two Pair, One Pair and High Card. Ace is the highest High Card, following by King, Queen, Jack, Ten, 9, 8, 7, 6, 5, 4, 3 and 2.

A Poker Bet wager can be settled with either one of the following rules:

Rules 1: If the Player's best 5-card poker hand ranks lower than the Banker's best 5-card poker hand, this wager loses. If the Player's best 5-card poker hand ranks the same as the Banker's, then the two hands tie and this wager neither wins nor loses. If the Player's best 5-card poker hand ranks higher than the Banker's, this wager wins and is paid Even Money (1 to 1), less a certain percent commission, preferably a 5% commission.

Rules 2: If the Player's best 5-card poker hand ranks lower than the Banker's best 5-card poker hand, the Player's Poker Bet wager loses. If the Player's best 5-card poker hand ranks the same as the Banker's, then the two hands tie and this wager neither wins nor loses. If the Player's best 5-card poker hand ranks higher than the Banker's, this wager wins, and either is paid Even Money (1 to 1) if the Banker's losing hand is 'not' King-Jack or lower (i.e., KJ987 is a King-Jack hand and QJ876 is a lower hand than a King-Jack hand), or is paid one half of the wager (1 to 2) if the Banker's losing hand is King-Jack or lower.

Rules 3: If the Player's best 5-card poker hand ranks lower than the Banker's best 5-card poker hand, the Player's Poker Bet wager loses. If the Player's best 5-card poker hand ranks the same as the Banker's, then the two hands tie and this wager neither wins nor loses. If the Player's best 5-card poker hand ranks higher than the Banker's, this wager wins, and either is paid Even Money (1 to 1) if the Banker's losing hand is "not" one of the predetermined hands that pays the Player's winning Poker Bet wager one half of the wager, or is paid one half of the wager (1 to 2) if the Banker's losing hand is one of the predetermined hands that pays the Player's winning Poker Bet wager one half of the wager.

Rules 4: If the Banker's best 5-card poker hand is 'not' one of the predetermined qualifying hands, such as hands of King-Ten or better, hands of Queen-Jack or better, hands of Queen-Ten or better, or etc., this wager is a tie and it neither wins nor loses. If the Player's best 5-card poker hand ranks lower than the Banker's and the Banker's best 5-card poker hand is one of the predetermined qualifying hands, this wager loses. If the Player's best 5-card poker hand ranks the same as the Banker's and the Banker's best 5-card poker hand is one of the predetermined qualifying hands, then the two hands tie and this wager neither wins nor loses. If the Player's best 5-card poker hand ranks higher than the Banker's and the Banker's best 5-card poker hand is one of the predetermined qualifying hands, this wager wins and is paid Even Money (1 to 1).

Rules 5: If the Banker's best 5-card poker hand is 'not' one of the predetermined qualifying hands, such as hands of Ace-King or better, hands of Ace-Jack or better, hands of King-Queen or better, or etc., this wager wins and is paid one half of the wager. If the Player's best 5-card poker hand ranks lower than the Banker's and the Banker's best 5-card poker hand is one of the predetermined qualifying hands, this wager loses. If the Player's best 5-card poker hand ranks the same as the Banker's and the Banker's best 5-card poker hand is one of the predetermined qualifying hands, then the two hands tie and this wager neither wins nor loses. If the Player's best 5-card poker hand ranks higher than the Banker's and the Banker's best 5-card poker hand is one of the predetermined qualifying hands, this wager wins and is paid Even Money (1 to 1).

SIDE BETS are bets that allow Players to bet on the contents of their own hand. A Player's side-bet wager wins if the Player's best 5-card poker hand is one of the predetermined winning hands of the type of side bet he or she bets on, regardless of the outcome of the Poker Bet wager; and this wager loses if the Player's best 5-card poker hand is not one of the predetermined winning hands. There are seven side bets and they are: Pair Of Aces Or Better Bet, Two Pair Or Better Bet, 3 Of A Kind Or Better Bet, Straight Or Better Bet, Flush Or Better Bet, Full House Or Better Bet and Bonus Bet.

PAIR OF ACES OR BETTER BET: A Player's Pair Of Aces Or Better Bet wager wins if the Player's best 5-card poker hand is a pair of Aces, Two Pair, 3 of a Kind, Straight, Flush, Full House, 4 of a Kind, Straight Flush, Royal Flush or 5 of a Kind; and this wager loses if the Player's best 5-card poker hand is not one of the above winning hands.

Pair Of Aces Or Better Bet pays Even Money (1 to 1) on any one of the above winning hands. Alternatively, any other appropriate payout odds can be used.

TWO PAIR OR BETTER BET: A Player's Two Pair Or Better Bet wager wins if the Player's best 5-card poker hand is Two Pair, 3 of a Kind, Straight, Flush, Full House, 4 of a Kind, Straight Flush, Royal Flush or 5 of a Kind; and this wager loses if the Player's best 5-card poker hand is not one of the above winning hands. Two Pair Or Better Bet pays Even Money (1 to 1) on a hand of Two Pair, 3 of a Kind, Straight or Flush, and pays 3 to 1 on a hand of Full House, 4 of a Kind, Straight Flush, Royal Flush or 5 of a Kind. Alternatively, any other appropriate payout odds can be used.

3 OF A KIND OR BETTER BET: A Player's 3 Of A Kind Or Better Bet wager wins if the Player's best 5-card poker hand is 3 of a Kind, Straight, Flush, Full House, 4 of a Kind, Straight Flush, Royal Flush or 5 of a Kind; and this wager loses if the Player's best 5-card poker hand is not one of the above winning hands. 3 Of A Kind Or Better Bet pays 4 to 1 on any one of the above winning hands. Alternatively, any other appropriate payout odds can be used.

STRAIGHT OR BETTER BET: A Player's Straight Or Better Bet wager wins if the Player's best 5-card poker hand is Straight, Flush, Full House, 4 of a Kind, Straight Flush, Royal Flush or 5 of a Kind; and this wager loses if the Player's best 5-card poker hand is not one of the above winning hands. Straight Or Better Bet pays 5 to 1 on any one of the above hands. Alternatively, any other appropriate payout odds can be used.

FLUSH OR BETTER BET: A Player's Flush Or Better Bet wager wins if the Player's best 5-card poker hand is Flush, Full House, 4 of a Kind, Straight Flush, Royal Flush or 5 of a Kind; and this wager loses if the Player's best 5-card poker hand is not one of the above winning hands. Flush Or Better Bet pays 11 to 1on any one of the above winning hands. Alternatively, any other appropriate payout odds can be used.

FULL HOUSE OR BETTER BET: A Player's Full House Or Better Bet wager wins if the Player's best 5-card poker hand is Full House, 4 of a Kind, Straight Flush, Royal Flush or 5 of a Kind; and this wager loses if the Player's best 5-card poker hand is not one of the above winning hands. Full House Or Better Bet pays 28 to 1 on any one of the above hands. Alternatively, any other appropriate payout odds can be used.

BONUS BET: Either one of the following games can be selected for the game of Bonus Bet:

Game 1: A Player's Bonus Bet wager wins if the Player's best 5-card poker hand is Straight, Flush, Full House, 4 of a Kind, Straight Flush, Royal Flush or 5 of a Kind; and this wager loses if the Player's best 5-card poker hand is not one of the above winning hands. The winning wager is paid according to the pay table below:

| Hand | Payout Odds |
|---|---|
| 5 of a Kind | 500 to 1 |
| Royal Flush | 200 to 1 |
| Straight Flush | 50 to 1 |
| 4 of a Kind | 25 to 1 |
| Full House | 7 to 1 |
| Flush | 4 to 1 |
| Straight | 3 to 1 |

Alternatively, any other appropriate pay table can be used.

Game 2: A Player's Bonus Bet wager wins if the Player's best 5-card poker hand is Flush, Full House, 4 of a Kind, Straight Flush, Royal Flush or 5 of a Kind; and this wager loses if the Player's best 5-card poker hand is not one of the above winning hands. The winning wager is paid according to the pay table below:

| Hand | Payout Odds |
|---|---|
| 5 of a Kind | 1,000 to 1 |
| Royal Flush | 300 to 1 |
| Straight Flush | 100 to 1 |
| 4 of a Kind | 50 to 1 |
| Full House | 9 to 1 |
| Flush | 4 to 1 |

Alternatively, any other appropriate pay table can be used.

After reading their cards, each Player places his or her cards face down on the appropriate spaces of the table layout. The dealer then reveals the Banker's six remaining cards, selects and keeps the Banker's best 5-card poker hand and discards two other cards, and settles each Player's side-bet wager(s) first if any, then the Player's Poker Bet wager if any, against the Banker.

DETAILED DESCRIPTION OF THE INVENTION

Figure 1:
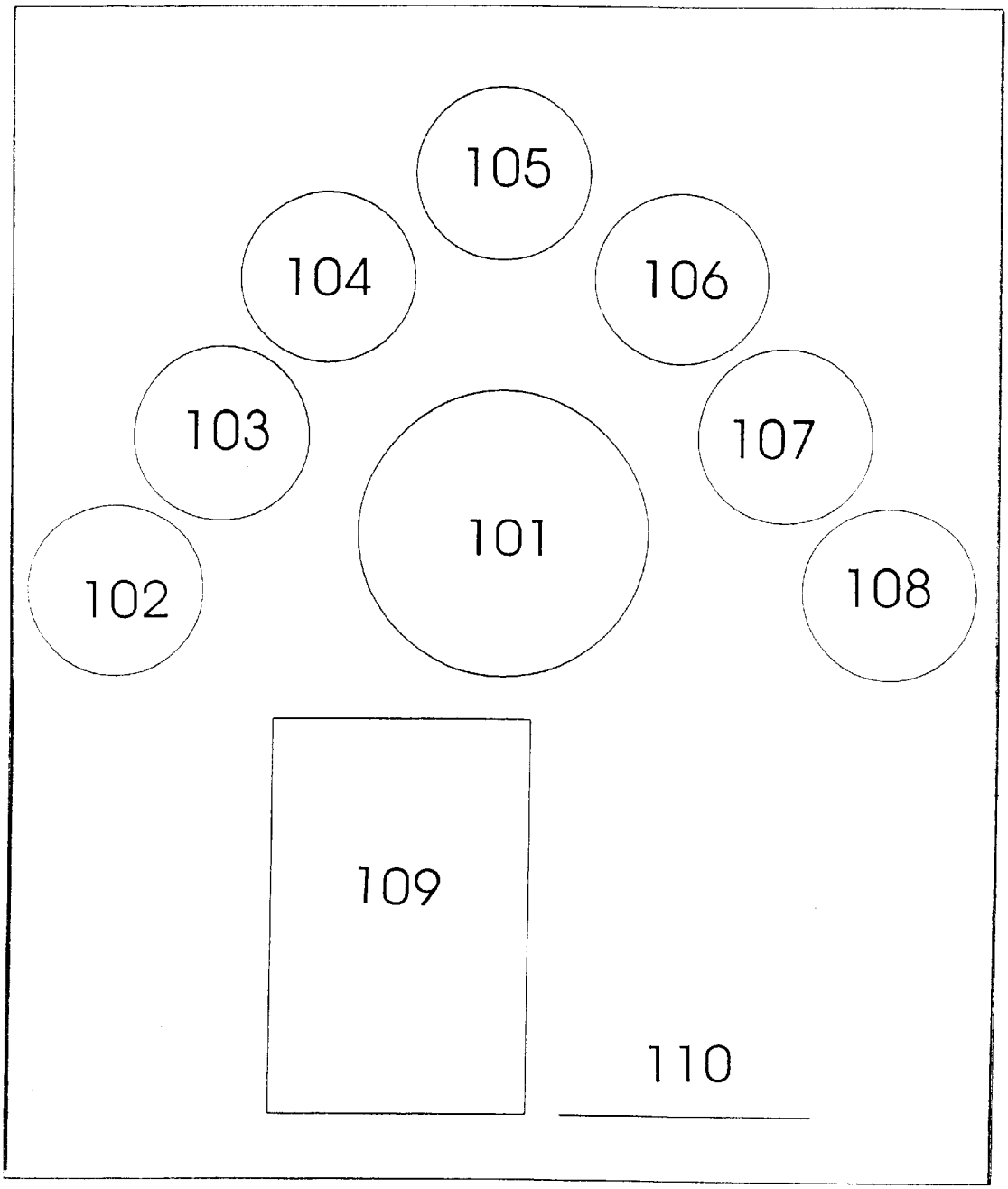
FIG. 1 shows a Player's betting area of the table layout of the eight-bet version of the invention: 101 is Poker Bet spot; 102, Pair Of Aces Or Better Bet spot; 103, Two Pair Or Better Bet spot; 104, 3 Of A Kind Or Better Bet spot; 105, Straight Or Better Bet spot; 106, Flush Or Better Bet spot; 107, Full House Or Better Bet spot; 108, Bonus Bet spot; 109, a Player's best 5-card poker hand space; and 110, a Player's two discards space.
Figure 2:
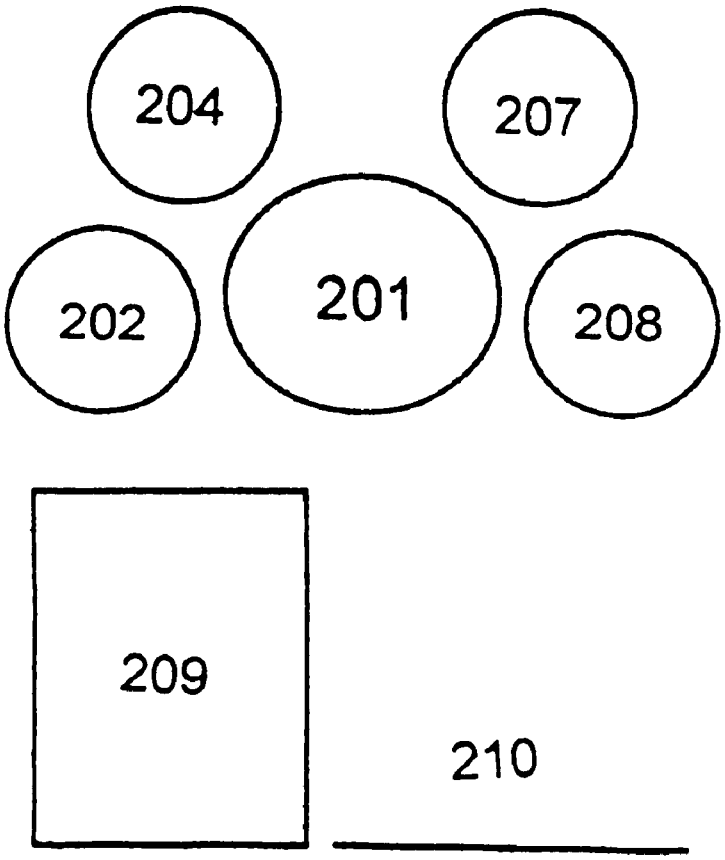
FIG. 2 shows a Player's betting area of the table layout of the preferred five-bet version of the invention: 201 is Poker Bet spot; 202, Pair Of Aces Or Better Bet spot; 204, 3 Of A Kind Or Better Bet spot; 207, Full House Or Better Bet spot; 208, Bonus Bet spot; 209, a Player's best 5-card poker hand space; 210, a Player's two discards space.
Figure 3:
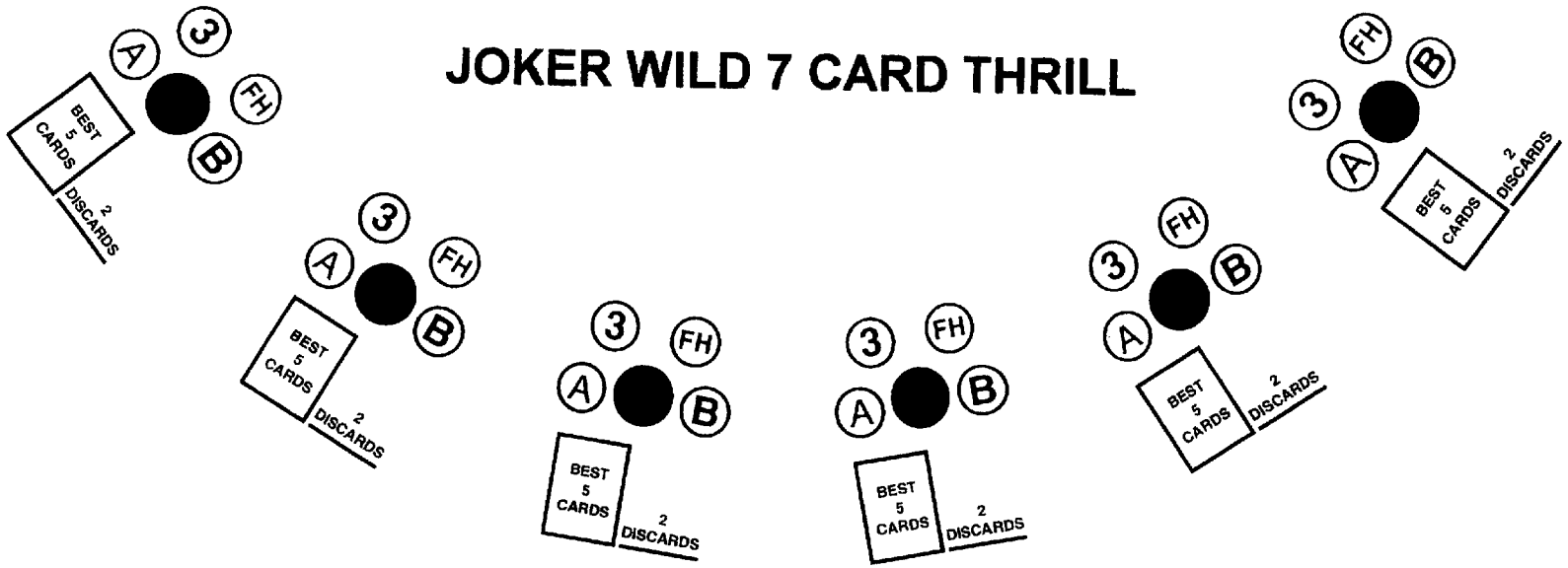
FIG. 3 shows the table layout of the preferred five-bet version of the invention.

In the preferred embodiment of the invention provides a seven-card stud poker game, played with one standard poker deck of 52 cards plus one Joker. Other embodiments include versions that would be played with at least one standard poker deck of 52 cards plus at least one Joker. In an embodiment, the invention is played with at least one standard poker deck of 52 cards, wherein either all Twos, all Threes, all Fours, all Fives, all Sixes, all Sevens, all Eights, all Nines, all Tens, all Jacks, all Queens, all Kings, or all Aces are Wild Cards. In another embodiment, the invention is played with at least one standard poker deck of 52 cards.

In the preferred embodiment, each Joker or each Wild Card can be used as any card. In an embodiment, each Joker or each Wild Card can be used as an Ace, or to form a Straight or Flush.

In the preferred embodiment, the invention offers seven positions, six Players and one Banker; table size, management of players, players' bets, and speed of play are the key reasons for the choice of seven positions. In other embodiments, lesser or greater than seven positions can be created in accordance with this invention if, for example, multiple decks are used.

A Player who is not a Banker may play Poker Bet playing against the Banker's hand and/or one to seven side bets betting on the contents of the Player's own hand. After at least one wager is placed, each Player and the Banker are each dealt seven cards. In the preferred embodiment, each Player and the Banker each receives his or her own seven-card dealt hand, starting from the Player sitting to the immediate left of the dealer, continuing in a clockwise fashion and ending with the Banker. Cards are preferably dealt to each Player and to the Banker one card at a time for seven times if the cards are shuffled by a dealer; the cards are preferably dealt to each Player and to the Banker in a stack of seven cards if the cards are shuffled by a shuffling device. In an embodiment, seven hands of seven cards are always dealt, regardless of the actual number of players; and some random number generation device such as a random number generator display or a dice shaker, is used to assign the dealt hands to players to reduce the likelihood of problems in dealing. In other embodiments, every Player and the Banker will receive their hand in either one of the following fashions:

1. they receive their own six cards and one community card;
2. they receive their own five cards and two community cards;
3. they receive their own four cards and three community cards;
4. they receive their own three cards and four community cards;
5. they receive their own two cards and five community cards;
6. they receive their own one card and six community cards; and
7. they receive no card their own and seven community cards.

Once the dealer has delivered the cards to all players, the dealer turns over the Banker's seven cards with only the top card exposed. Each Player selects and keeps his or her best 5-card poker hand, discards two other cards, and then places the cards face down on the appropriate spaces of the table layout. The dealer then reveals the Banker's six remaining cards, selects and keeps the Banker's best 5-card poker hand, discards two other cards, opens the cards of the Player at the immediate right of the dealer, and settles the Player's side-bet wager(s) first if any, and then the Player's Poker Bet wager if any, against the Banker. After completing the transaction of the Player at the immediate right of the dealer, the dealer moves on and completes the transaction of the next Player, and so on. Upon the completion of all transactions, a new round of play will begin.

POKER BET is a bet that allows a Player to place a wager playing against the Banker's hand. The object of Poker bet is to have a best 5-card poker hand that outranks the Banker's best 5-card poker hand. In the Poker Bet game, the Player's best 5-card poker hand is compared to the Banker's best 5-card poker hand according to traditional poker rankings, wherein hands are ranked in descending order as follows: 5 of a Kind, Royal Flush, Straight Flush, 4 of a Kind, Full House, Flush, Straight, 3 of a Kind, Two Pair, One Pair and High Card. Ace is the highest High Card, following by King, Queen, Jack, Ten, 9, 8, 7, 6, 5, 4, 3 and 2.

A Poker Bet wager can be settled with either one of the following rules:

Rules 1: If the Player's best 5-card poker hand ranks lower than the Banker's best 5-card poker hand, this wager loses. If the Player's best 5-card poker hand ranks the same as the Banker's, then the two hands tie and this wager neither wins nor loses. If the Player's best 5-card poker hand ranks higher than the Banker's, this wager wins and is paid Even Money (1 to 1), less a certain percent commission, preferably a 5% commission.

Rules 2: If the Player's best 5-card poker hand ranks lower than the Banker's best 5-card poker hand, the Player's Poker Bet wager loses. If the Player's best 5-card poker hand ranks the same as the Banker's, then the two hands tie and this wager neither wins nor loses. If the Player's best 5-card poker hand ranks higher than the Banker's, this wager wins, and either is paid Even Money (1 to 1) if the Banker's losing hand is 'not' King-Jack or lower, or is paid one half of the wager (1 to 2) if the Banker's losing hand is King-Jack or lower.

Rules 3: If the Player's best 5-card poker hand ranks lower than the Banker's best 5-card poker hand, the Player's Poker Bet wager loses. If the Player's best 5-card poker hand ranks the same as the Banker's, then the two hands tie and this wager neither wins nor loses. If the Player's best 5-card poker hand ranks higher than the Banker's, this wager wins, and either is paid Even Money (1 to 1) if the Banker's losing hand is "not" one of the predetermined hands that pays the Player's winning Poker Bet wager one half of the wager, or is paid one half of the wager (1 to 2) if the Banker's losing hand is one of the predetermined hands that pays the Player's winning Poker Bet wager one half of the wager.

Rules 4: If the Banker's best 5-card poker hand is 'not' one of the predetermined qualifying hands, such as hands of King-Ten or better, hands of Queen-Jack or better, hands of Queen-Ten or better, or etc., this wager is a tie and it neither wins nor loses. If the Player's best 5-card poker hand ranks lower than the Banker's and the Banker's best 5-card poker hand is one of the predetermined qualifying hands, this wager loses. If the Player's best 5-card poker hand ranks the same as the Banker's and the Banker's best 5-card poker hand is one of the predetermined qualifying hands, then the two hands tie and this wager neither wins nor loses. If the Player's best 5-card poker hand ranks higher than the Banker's and the Banker's best 5-card poker hand is one of the predetermined qualifying hands, this wager wins and is paid Even Money (1 to 1).

Rules 5: If the Banker's best 5-card poker hand is 'not' one of the predetermined qualifying hands, such as hands of Ace-King or better, hands of Ace-Jack or better, hands of King-Queen or better, or etc., this wager wins and is paid one half of the wager. If the Player's best 5-card poker hand ranks lower than the Banker's and the Banker's best 5-card poker hand is one of the predetermined qualifying hands, this wager loses. If the Player's best 5-card poker hand ranks the same as the Banker's and the Banker's best 5-card poker hand is one of the predetermined qualifying hands, then the two hands tie and this wager neither wins nor loses. If the Player's best 5-card poker hand ranks higher than the Banker's and the Banker's best 5-card poker hand is one of the predetermined qualifying hands, this wager wins and is paid Even Money (1 to 1).

SIDE BETS are bets that allow Players to bet on the contents of their own hand. A Player's side-bet wager wins if the Player's best 5-card poker hand is one of the predetermined winning hands of the type of side bet he or she bets on, regardless of the outcome of the Poker Bet wager; and this wager loses if the Player's best 5-card poker hand is not one of the predetermined winning hands. There are seven side bets and they are: Pair Of Aces Or Better Bet, Two Pair Or Better Bet, 3 Of A Kind Or Better Bet, Straight Or Better Bet, Flush Or Better Bet, Full House Or Better Bet and Bonus Bet.

PAIR OF ACES OR BETTER BET: A Player's Pair Of Aces Or Better Bet wager wins if the Player's best 5-card poker hand is a pair of Aces, Two Pair, 3 of a Kind, Straight, Flush, Full House, 4 of a Kind, Straight Flush, Royal Flush or 5 of a Kind; and this wager loses if the Player's best 5-card poker hand is not one of the above winning hands. Pair Of Aces Or Better Bet pays Even Money (1 to 1) on any one of the above winning hands. Alternatively, any other appropriate payout odds can be used.

TWO PAIR OR BETTER BET: A Player's Two Pair Or Better Bet wager wins if the Player's best 5-card poker hand is Two Pair, 3 of a Kind, Straight, Flush, Full House, 4 of a Kind, Straight Flush, Royal Flush or 5 of a Kind; and this wager loses if the Player's best 5-card poker hand is not one of the above winning hands. Two Pair Or Better Bet pays Even Money (1 to 1) on a hand of Two Pair, 3 of a Kind, Straight or Flush, and pays 3 to 1 on a hand of Full House, 4 of a Kind, Straight Flush, Royal Flush or 5 of a Kind. Alternatively, any other appropriate payout odds can be used.

3 OF A KIND OR BETTER BET: A Player's 3 Of A Kind Or Better Bet wager wins if the Player's best 5-card poker hand is 3 of a Kind, Straight, Flush, Full House, 4 of a Kind, Straight Flush, Royal Flush or 5 of a Kind; and this wager loses if the Player's best 5-card poker hand is not one of the above winning hands. 3 Of A Kind Or Better Bet pays 4 to 1 on any one of the above winning hands. Alternatively, any other appropriate payout odds can be used.

STRAIGHT OR BETTER BET: A Player's Straight Or Better Bet wager wins if the Player's best 5-card poker hand is Straight, Flush, Full House, 4 of a Kind, Straight Flush, Royal Flush or 5 of a Kind; and this wager loses if the Player's best 5-card poker hand is not one of the above winning hands. Straight Or Better Bet pays 5 to 1 on any one of the above hands. Alternatively, any other appropriate payout odds can be used.

FLUSH OR BETTER BET: A Player's Flush Or Better Bet wager wins if the Player's best 5-card poker hand is Flush, Full House, 4 of a Kind, Straight Flush, Royal Flush or 5 of a Kind; and this wager loses if the Player's best 5-card poker hand is not one of the above winning hands. Flush Or Better Bet pays 11 to 1on any one of the above winning hands. Alternatively, any other appropriate payout odds can be used.

FULL HOUSE OR BETTER BET: A Player's Full House Or Better Bet wager wins if the Player's best 5-card poker hand is Full House, 4 of a Kind, Straight Flush, Royal Flush or 5 of a Kind; and this wager loses if the Player's best 5-card poker hand is not one of the above winning hands. Full House Or Better Bet pays 28 to 1 on any one of the above hands. Alternatively, any other appropriate payout odds can be used.

BONUS BET: Either one of the following games can be selected for the game of Bonus Bet:

Game 1: A Player's Bonus Bet wager wins if the Player's best 5-card poker hand is Straight, Flush, Full House, 4 of a Kind, Straight Flush, Royal Flush or 5 of a Kind; and this wager loses if the Player's best 5-card poker hand is not one of the above winning hands. The winning wager is paid according to the pay table below:

| Hand | Payout Odds |
|---|---|
| 5 of a Kind | 500 to 1 |
| Royal Flush | 200 to 1 |

-continued

| Hand | Payout Odds |
|---|---|
| Straight Flush | 50 to 1 |
| 4 of a Kind | 25 to 1 |
| Full House | 7 to 1 |
| Flush | 4 to 1 |
| Straight | 3 to 1 |

Alternatively, any other appropriate pay table can be used.

Game 2: A Player's Bonus Bet wager wins if the Player's best 5-card poker hand is Flush, Full House, 4 of a Kind, Straight Flush, Royal Flush or 5 of a Kind; and this wager loses if the Player's best 5-card poker hand is not one of the above winning hands. The winning wager is paid according to the pay table below:

| Hand | Payout Odds |
|---|---|
| 5 of a Kind | 1,000 to 1 |
| Royal Flush | 300 to 1 |
| Straight Flush | 100 to 1 |
| 4 of a Kind | 50 to 1 |
| Full House | 9 to 1 |
| Flush | 4 to 1 |

Alternatively, any other appropriate pay table can be used.

CREATING OTHER VERSIONS OF 6 CARD THRILL

The games of Poker Bet and 7 side bets are the subgames of Joker Wild 7 Card Thrill. There are many ways to create other versions of Joker Wild 7 Card Thrill and they are:

1. Joker Wild 7 Card Thrill consists of the game of Poker Bet only.
2. Joker Wild 7 Card Thrill consists of the games of Poker Bet and any one of 7 side bets.
3. Joker Wild 7 Card Thrill consists of the games of Poker Bet and any two of 7 side bets.
4. Joker Wild 7 Card Thrill consists of the games of Poker Bet and any three of 7 side bets.
5. Joker Wild 7 Card Thrill consists of the games of Poker Bet and any four of 7 side bets.
6. Joker Wild 7 Card Thrill consists of the games of Poker Bet and any five of 7 side bets.
7. Joker Wild 7 Card Thrill consists of the games of Poker Bet and any six of 7 side bets.
8. Joker Wild 7 Card Thrill consists of the game of any one of 7 side bets.
9. Joker Wild 7 Card Thrill consists of the games of any two of 7 side bets.
10. Joker Wild 7 Card Thrill consists of the games of any three of 7 side bets.
11. Joker Wild 7 Card Thrill consists of the games of any four of 7 side bets.
12. Joker Wild 7 Card-Thrill consists of the games of any five of 7 side bets.
13. Joker Wild 7 Card Thrill consists of the games of any six of 7 side bets. And
14. Joker Wild 7 Card Thrill consists of the games of all 7 side bets.

What is claimed is:

1. A method of playing a card game among a plurality of Players and a Banker, each Player wagering against the Banker, the method comprising the following steps:

(a) providing and shuffling at least one standard poker deck of 52 cards plus at least one Joker;

(b) each Player placing at least one wager of Poker Bet and side bets, wherein side bets include Pair Of Aces Or Better Bet, Two Pair Or Better Bet, 3 Of A Kind Or Better Bet, Straight Or Better Bet, Flush Or Better Bet, Full House Or Better Bet and Bonus Bet;

(c) dealing cards into enough dealt hands of seven cards to provide a dealt hand for each Player and for the Banker;

(d) determining which dealt hand is assigned to each Player and which dealt hand is assigned to the Banker;

(e) from their own seven-card dealt hand, each Player and the Banker selecting and keeping their own best 5-card poker hand and discarding two other cards;

(f) determining whether each Player's side-bet wager or wagers win or lose, if any;

(g) settling each Player's side-bet wager or wagers against the Banker;

(h) determining whether each Player's Poker Bet wager wins, loses or ties, if any, wherein each Player's best 5-card poker hand is compared to the Banker's best 5-card poker hand;

wherein said hands are ranked in descending order as follows: 5 of a Kind, Royal Flush, Straight Flush, 4 of a Kind, Full House, Flush, Straight, 3 of a Kind, Two Pair, One Pair and High Card;

wherein Ace is the highest High Card, following by King, Queen, Jack, Ten, 9, 8, 7, 6, 5, 4, 3 and 2;

wherein a hand of A, 2, 3, 4, and 5 is the lowest Straight and that it is suited, a hand of A, 2, 3, 4, and 5 is the lowest Straight Flush; and (i) settling each Player's Poker Bet wager against the Banker.

2. The method of playing a card game according to claim 1, wherein the card game of the invention uses one standard poker deck of 52 cards plus one Joker.

3. The method of playing a card game according to claim 1, wherein the Joker may be used as any card.

4. The method of playing a card game according to claim 1, wherein a Player's Pair Of Aces Or Better Bet wager wins if the Player's best 5-card poker hand is a pair of Aces, Two Pair, 3 of a Kind, Straight, Flush, Full House, 4 of a Kind, Straight Flush, Royal Flush or 5 of a Kind; and this wager loses if the Player's best 5-card poker hand is not one of the aforesaid winning hands.

5. The method of playing a card game according to claim 4, wherein Pair Of Aces Or Better Bet pays Even Money, namely 1 to 1, on a hand of a pair of Aces, Two Pair, 3 of a Kind, Straight, Flush, Full House, 4 of a Kind, Straight Flush, Royal Flush or 5 of a Kind.

6. The method of playing a card game according to claim 1, wherein a Player's Two Pair or Better Bet wager wins if the Player's best 5-card poker hand is Two Pair, 3 of a Kind, Straight, Flush, Full House, 4 of a Kind, Straight Flush, Royal Flush or 5 of a Kind; this wager loses if the Player's best 5-card poker hand is not one of the aforesaid winning hands.

7. The method of playing a card game according to claim 6, wherein Two Pair Or Better Bet pays Even Money, namely 1 to 1on a hand of Two Pair, 3 of a Kind, Straight or Flush, and pays 3 to 1 on a hand of Full House, 4 of a Kind, Straight Flush, Royal Flush or 5 of a Kind.

8. The method of playing a card game according to claim 1, wherein a Player's 3 Of A Kind Or Better Bet wager wins if the Player's best 5-card poker hand is 3 of a Kind, Straight, Flush, Full House, 4 of a Kind, Straight Flush, Royal Flush or 5 of a Kind; and this wager loses if the Player's best 5-card poker hand is not one of the aforesaid winning hands.

9. The method of playing a card game according to claim 8, wherein 3 Of A Kind Or Better Bet pays 4 to 1 on a hand of 3 of a Kind, Straight, Flush, Full House, 4 of a Kind, Straight Flush, Royal Flush or 5 of a Kind.

10. The method of playing a card game according to claim 1, wherein a Player's Straight Or Better Bet wager wins if a Player's best 5-card poker hand is Straight, Flush, Full House, 4 of a Kind, Straight Flush, Royal Flush or 5 of a Kind; and this wager loses if the Player's best 5-card poker hand is not one of the aforesaid winning hands.

11. The method of playing a card game according to claim 10, wherein Straight Or Better Bet pays 5 to 1 on a hand of Straight, Flush, Full House, 4 of a Kind, Straight Flush, Royal Flush or 5 of a Kind.

12. The method of playing a card game according to claim 10, wherein Straight Or Better Bet pays 500 to 1 on a hand of 5 of a Kind, 200 to 1 on a hand of Royal Flush, 50 to 1 on a hand of Straight Flush, 25 to 1 on a hand of 4 of a Kind, 7 to 1 on a hand of Full House, 4 to 1 on a hand of Flush, and 3 to 1 on a hand of Straight.

13. The method of playing a card game according to claim 1, wherein a Player's Flush Or Better Bet wager wins if the Player's best 5-card poker hand is Flush, Full House, 4 of a Kind, Straight Flush, Royal Flush or 5 of a Kind; this wager loses if the Player's best 5-card poker hand is not one of the aforesaid winning hands.

14. The method of playing a card game according to claim 13, wherein Flush Or Better Bet wager pays 11 to 1on a hand of Flush, Full House, 4 of a Kind, Straight Flush, Royal Flush or 5 of a Kind.

15. The method of playing a card game according to claim 13, wherein Flush Or Better Bet pays 1,000 to 1 on a hand of 5 of a Kind, 300 to 1 on a hand of Royal Flush, 100 to 1 on a hand of Straight Flush, 50 to 1 on a hand of 4 of a Kind, 9 to 1 on a hand of Full House, and 4 to 1 on a hand of Flush.

16. The method of playing a card game according to claim 1, wherein a Player's Poker Bet wager is settled against the Banker as follows:

if the Player's best 5-card poker hand ranks lower than the Banker's best 5-card poker hand, the Player's Poker Bet wager loses;

if the Player's best 5-card poker hand ranks the same as the Banker's, then the two hands tie and this wager neither wins nor loses;

if the Player's best 5-card poker hand ranks higher than the Banker's, this wager wins and is paid Even Money, namely 1 to 1, less a certain percent commission.

17. The method of playing a card game according to claim 1, wherein a Player's Poker Bet wager is settled against the Banker as follows:

if the Player's best 5-card poker hand ranks lower than the Banker's best 5-card poker hand, the Player's Poker Bet wager loses;

if the Player's best 5-card poker hand ranks the same as the Banker's, then the two hands tie and this wager neither wins nor loses;

if the Player's best 5-card poker hand ranks higher than the Banker's, this wager wins and is paid Even Money, namely 1 to 1, less a 5% commission.

18. The method of playing a card game according to claim 1, wherein a Player's Poker Bet wager is settled against the Banker as follows:

if the Player's best 5-card poker hand ranks lower than the Banker's best 5-card poker hand, the Player's Poker Bet wager loses;

if the Player's best 5-card poker hand ranks the same as the Banker's, then the two hands tie and this wager neither wins nor loses;

if the Player's best 5-card poker hand ranks higher than the Banker's, this wager wins and either is paid Even Money, namely 1 to 1, if the Banker's losing hand is not King-Jack or lower, or is paid one half of the wager, namely 1 to 2, if the Banker's losing hand is King-Jack or lower.

19. The method of playing a card game according to claim 1, wherein a Player's Poker Bet wager is settled against the Banker as follows:

if the Player's best 5-card poker hand ranks lower than the Banker's best 5-card poker hand, the Player's Poker Bet wager loses;

if the Player's best 5-card poker hand ranks the same as the Banker's, then the two hands tie and this wager neither wins nor loses;

if the Player's best 5-card poker hand ranks higher than the Banker's, this wager wins, and either is paid Even Money, namely 1 to 1, if the Banker's losing hand is not one of the predetermined hands that pays the Player's winning Poker Bet wager one half of the wager, or is paid one half of the wager, namely 1 to 2, if the Banker's losing hand is one of the predetermined hands that pays the Player's winning Poker Bet wager one half of the wager.

20. The method of playing a card game according to claim 1, wherein a Player's Poker Bet wager is settled against the Banker as follows:

if the Banker's best 5-card poker hand is not one of the predetermined qualifying hands, the Player's Poker Bet wager is a tie and it neither wins nor loses;

if the Player's best 5-card poker hand ranks lower than the Banker's and the Banker's best 5-card poker hand is one of the predetermined qualifying hands, this wager loses;

if the Player's best 5-card poker hand ranks the same as the Banker's and the Banker's best 5-card poker hand is one of the predetermined qualifying hands, then the two hands tie and this wager neither wins nor loses;

if the Player's best 5-card poker hand ranks higher than the Banker's and the Banker's best 5-card poker hand is one of the predetermined qualifying hands, this wager wins and is paid Even Money, namely 1 to 1.

21. The method of playing a card game according to claim 1, wherein a Player's Poker Bet wager is settled against the Banker as follows:

if the Banker's best 5-card poker hand is not one of the predetermined qualifying hands, the Player's Poker Bet wager wins and is paid one half of the wager;

if the Player's best 5-card poker hand ranks lower than the Banker's and the Banker's best 5-card poker hand is one of the predetermined qualifying hands, this wager loses;

if the Player's best 5-card poker hand ranks the same as the Banker's and the Banker's best 5-card poker hand is one of the predetermined qualifying hands, then the two hands tie and this wager neither wins nor loses;

if the Player's best 5-card poker hand ranks higher than the Banker's and the Banker's best 5-card poker hand is one of the predetermined qualifying hands, this wager wins and is paid Even Money, namely 1 to 1.

* * * * *